United States Patent [19]

Meyer

[11] Patent Number: 4,758,098

[45] Date of Patent: Jul. 19, 1988

[54] STATIC MIXING DEVICE FOR FLUIDS CONTAINING OR CONSISTING OF SOLID PARTICLES

[75] Inventor: Hans Meyer, Elgg, Switzerland

[73] Assignee: Sulzer Brothers Limited, Winterthur, Switzerland

[21] Appl. No.: 931,693

[22] Filed: Nov. 14, 1986

[30] Foreign Application Priority Data

Dec. 11, 1985 [CH] Switzerland ..... 5282/85

[51] Int. Cl.[4] ..... B01F 5/06

[52] U.S. Cl. ..... 366/337; 366/336

[58] Field of Search ..... 366/336, 337, 338, 339

[56] References Cited

U.S. PATENT DOCUMENTS

| | | | |
|---|---|---|---|
| 3,923,288 | 12/1975 | King | 366/336 |
| 4,019,719 | 4/1977 | Schuster et al. | 366/338 |
| 4,643,584 | 2/1987 | Allocca | 366/337 |
| 4,692,030 | 9/1987 | Tauscher et al. | 366/336 |

*Primary Examiner*—Harvey C. Hornsby
*Assistant Examiner*—Corinne M. Reinckens
*Attorney, Agent, or Firm*—Kenyon & Kenyon

[57] ABSTRACT

The static mixing device employs mixing elements, each of which has at least three transversely spaced webs. The webs are spaced transversely from each other to provide gaps through which a fluid may pass during mixing. In addition, each web while being secured to the casing at the upper ends relative to a downward flow has lower terminal ends which are spaced from the casing to provide further gaps through which the liquid may pass during a downward descent.

8 Claims, 2 Drawing Sheets

STATIC MIXING DEVICE FOR FLUIDS CONTAINING OR CONSISTING OF SOLID PARTICLES

Figure 1:
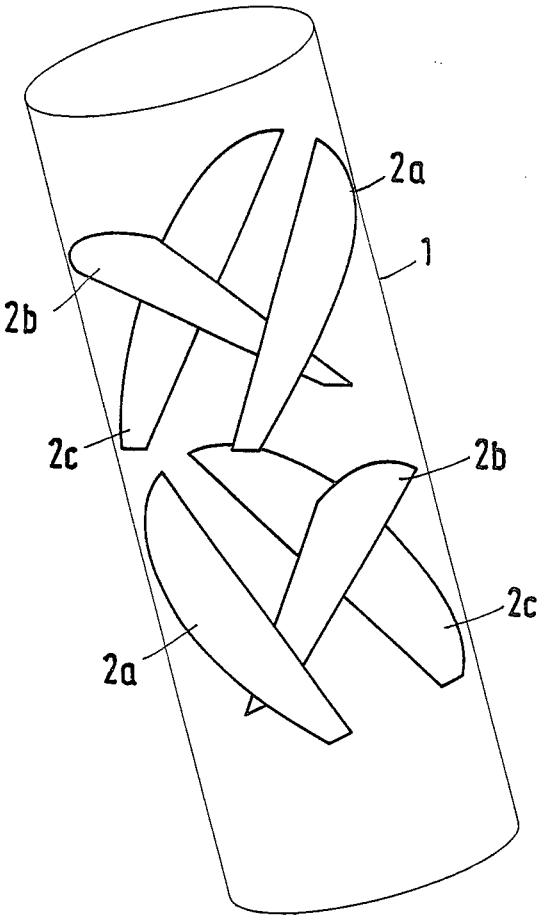

This invention relates to a static mixing device. More particularly, this invention relates to a static mixing device for fluids containing or consisting of solid particles.

Heretofore, various types of static mixing devices have been known for the mixing of various types of fluids. For example, Swiss Patents Nos., 662,564; 547,120 and 578,370 each describe a static mixing device which can be used for the mixing of fluids. However, the static mixing devices described in these patents all suffer from a disadvantages of tending to become clogged when dealing with fluids which contain or consist of solid particles. Fluids of this kind can be in the form, for example of various granulates which are required to be uniformly mixed together, or liquids containing, for example, fibers or other solid particles. Generally, these fluids may occur in public water treatment, for example, in the mixing of chemicals into a sludge, in the paper making industry and in the food industries, for example when pieces of fruit are to be mixed into yogurt.

Accordingly, it is an object of the invention to provide a static mixing device which does not clog when mixing fluids containing or consisting of solid particles.

It is another object of the invention to provide a non-clogging static mixing device which ensures a homogenous mixing at an acceptable pressure drop.

Briefly, the invention provides a static mixing device comprised of a tubular casing which defines a flow path and at least three webs disposed within and tranversely across the casing. Each web is disposed in transverely spaced crossing relation to a transversely adjacent web while being inclined to a longitudinal axis of the casing. In accordance with the invention, the outermost webs have an outer edge secured to the casing in sealed relation and a terminal end spaced from the casing to define a gap therewith. Each remaining inner web has an outer edge secured to the casing in sealed relation and an opposite terminal end spaced from the casing.

The construction of the webs is such that a simple means is provided with prevents particles of solid matter from being deposited or caught between the webs and the wall of the tubular casing or between crossing webs. Hence, satisfactory mixing can proceed in the device of a fluid containing or consisting of solid particles.

The transversely disposed webs serve to form a mixing element within the tubular casing. In addition, a plurality of sets of webs may be disposed along the length of the casing in order to define a plurality of mixing elements. Further, the consecutively arranged mixing elements may be disposed in offset relation to each other so as to enhance the mixing capability of the static mixing device.

Figure 3:
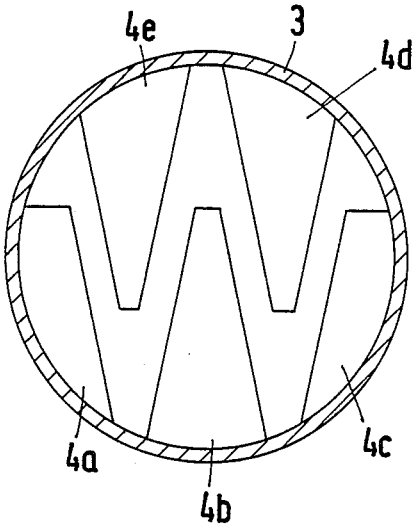
Figure 4:
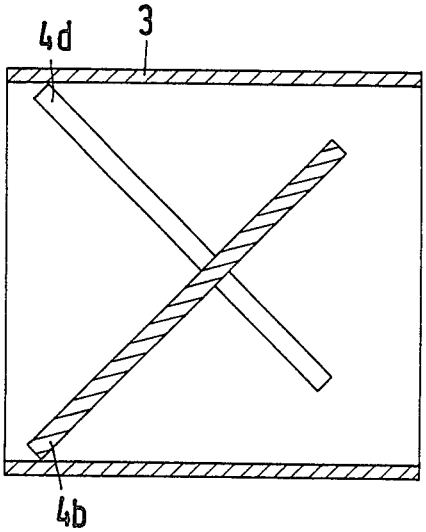

In one embodiment, each mixing element may be formed of three webs whereas in other embodiments, the webs may be of a greater number, for example, five. These and other objects and advantages of the invention will become more apparent from the following detailed description taken in conjunction with the drawings wherein:

FIG. 1 illustrates a perspective view of a cylindrical tubular casing having two mixing elements longitudinally disposed therein in accordance with the invention;

FIGS. 2*a* to 2*d* each illustrates a cross sectional view through a mixing element having four consecutively disposed mixing elements constructed in accordance with the invention;

FIG. 3 illustrates a cross sectional view of a modified mixing element employing five webs in accordance with the invention; and FIG. 4 illustrates a longitudinal sectional view of the static mixing device of FIG. 3.

Referring to FIG. 1, the static mixing device is formed of a cylindrical tubular casing 1 which defines a flow path for a fluid having solid particles therein. In addition, a pair of mixing elements are consecutively disposed in a 90° offset relation to each other longitudinally within the casing 1. As indicated, each mixing element is disposed in the casing for mixing a fluid passing therethrough.

Each mixing element is comprised of three webs 2*a*, 2*b*, 2*c*, with each web being disposed in transverely spaced crossing relation to a transversely adjacent web while being inclined to a longitudinal axis of the casing 1. In this way, a gap remains between the webs at the crossing points of the webs. In this respect, it may be convenient to form groove-like recesses at the crossing places of the webs in order to enlarge the gap.

Figure 2A:
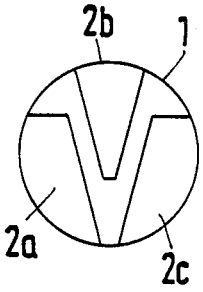

Referring to FIGS. 1 and 2*a*, the outermost webs 2*a*, 2*c*, have an outer edge which is secured to the casing 1 in sealed relation while a terminal end is spaced from the casing to define a gap therewith. As indicated, the outer edges of the webs 2*a*, 2*c* are contoured to fit the cylindrical wall of the tubular casing 1. The inner web 2*b* has an outer edge at the top as viewed which is secured to the casing 1 in sealed relation and a lower opposite terminal end which is spaced from the casing as more clearly shown in FIG. 2*a*.

The webs 2*a*, 2*b*, 2*c* can be welded or soldered to the tubular casing 1. Further, the casing 1 may be of other cross sectional shape than of circular cross sectional shape as viewed. For example, the casing may have a rectangular contour.

Referring to FIG. 2*a*, for improved flow behavior sofar as satisfactory detachment at the web ends is concerned, the web cross sections may narrow towards the free ends.

Advantageously, the angle which the webs make with the longitudinal axis of the casing 1 is in the range of from 30° to 60° and, more particularly, 30° and 45°.

Figure 2B:
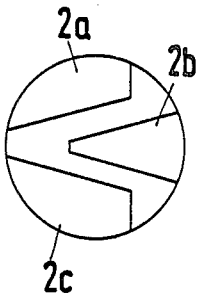
Figure 2C:
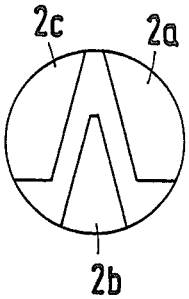
Figure 2D:
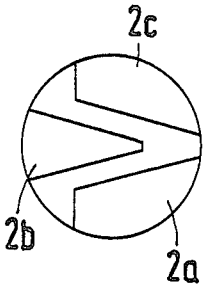

As indicated in FIGS. 2*a* and 2*b*, the webs 2*a*–2*c* of the consecutively disposed mixing elements are disposed in 90° offset relation to each other.

As indicated in FIGS. 2*a* to 2*d*, where a mixing device is provided with four mixing elements, the consecutively disposed elements may each be turned 90° relative to each other.

Referring to FIG. 3, a mixing element may be composed of five webs 4*a*–4*e*. As indicated, the outermost webs 4*a*, 4*c* each have an outer edge which is contoured to the cylindrical tubular casing 3 while the remaining inner webs 4*b*, 4*d*, 4*e* have an outer edge secured to the casing in sealed relation while the opposite terminal end is spaced from the casing wall.

As indicated in FIG. 4, the webs 4*a*, 4*b*, 4*c* to one side of the casing are disposed in parallel relation while the remaining webs 4*d*, 4*e* are in parallel relation to each other and in crossing relation to the webs 4*a*, 4*b*, 4*c*.

Of note, it is theoretically possible for the mixing device to have a number of webs in accordance with the process for which the mixing device is to be used.

Mixing devices according to the invention have been tested experimentally for various uses. For example, colored and uncolored plastics granulate have been introduced into a static mixer constructed in the above fashion through a faller with a uniform color distribution being achieved during mixing.

Other uses may reside, for example in mixing flocculating agents into secondary clarified sludge before a centrifugal decanter of a public sewage works for sludge dewatering. The provision of a mixer according to the invention meets the requirement for rapid and uniform mixing in the manner necessary for effective use of chemicals.

Advantageously, the cross sections and the longitudinal sectional shapes have flow-enhancing contours and may, for example, be rectangular or elliptical or semicircular.

As indicated in FIG. 1, when in use, a flow of a fluid containing or consisting of fluid particles can be introduced into one end of the tubular casing 1, for example, at the upper end. As the flow passes over and between the webs 2*a*, 2*c* of each mixing element, a mixing of the fluid occurs. However, since the webs are spaced transversely from each other as well as from the casing at the lower ends, clogging of the mixing device is avoided.

The invention thus provides a static mixing device which does not become clogged when dealing with fluids which contain or consist of solid particles.

Further, the invention provides a non-clogging static mixing device which ensures a homogenous mixing at an accepable pressure drop.

As indicated in FIG. 1, the direction of flow through the casing 1 is from top to bottom. In the event that flow would be reversed, i.e. from bottom to top, then the webs 2*a*, 2*c* would be reversed in a sense that the lower ends would be secured to the casing while the upper terminal ends would be spaced from the casing. Likewise, for the embodiment illustrated in FIG. 4, the flow is from left to right. For a flow in the reverse direction, the orientation of the webs within the casing 3 would be reversed to accommodate the flow so that spaces are not provided in which the particles in the fluid flow may accumulate and clog.

I claim:

1. A static mixing device comprising a tubular casing defining a flow path for a fluid having solid particles therein; and at least one mixing element in said casing for mixing a fluid passing therethrough, said element including at least three webs in said flow path, each web being disposed in transversely spaced crossing relation to a transversely adjacent web and inclined to a longitudinal axis of said casing, the outermost webs of said webs having an outer edge secured to said casing in sealed relation and a terminal end spaced from said casing to define a gap therewith, and each remaining inner web having an outer edge secured to said casing in sealed relation and an opposite terminal end spaced from said casing.

2. A static mixing device as set forth in claim 1 wherein each web narrows toward said terminal end.

3. A static mixing device as set forth in claim 1 which comprises a plurality of said mixing elements consecutively disposed in said casing in 90° offset relation to each other.

4. A static mixing device as set forth in claim 1 wherein each web has a recess transversely opposite an adjacent web.

5. A static mixing device as set forth in claim 1 wherein said mixing element includes five webs.

6. A static mixing device comprising a tubular casing defining a flow path; and a plurality of mixing elements longitudinally disposed in said casing, at least one of said mixing elements including at least three webs in said flow path, each web being disposed in transversely spaced crossing relation to a transversely adjacent web and inclined to a longitudinal axis of said casing, the outermost webs of said webs having an outer edge secured to said casing in sealed relation and a terminal end spaced from said casing to define a gap therewith, and each remaining inner web having an outer edge secured to said casing in sealed relation and an opposite terminal end spaced from said casing.

7. A static mixing device as set forth in claim 6 wherein each web narrows toward said terminal end.

8. A static mixing device comprising a tubular casing defining a flow path; and at least three webs disposed within and transversely across said casing, each being disposed in transversely spaced crossing relation to a transversely adjacent web to define a gap between said webs at the crossing points of said webs, each web being inclined to a longitudianal axis of said casing, the outermost webs of said webs having an outer edge secured to said casing in sealed relation and a terminal downstream end relative to said flow path spaced from said casing to define a gap therewith, and each remaining inner web having an outer edge secured to said casing in sealed relation and an opposite terminal downstream end relative to said flow path spaced from said casing.

* * * * *

UNITED STATES PATENT AND TRADEMARK OFFICE

CERTIFICATE OF CORRECTION

PATENT NO. : 4,758,098

DATED : July 19, 1988

INVENTOR(S) : Hans Meyer

It is certified that error appears in the above-identified patent and that said Letters Patent is hereby corrected as shown below:

Column 4, line 40 "each being" should be -each web being-

Signed and Sealed this

Twenty-seventh Day of December, 1988

*Attest:*

DONALD J. QUIGG

*Attesting Officer*

*Commissioner of Patents and Trademarks*